US012616285B2

(12) United States Patent
Yester

(10) Patent No.: US 12,616,285 B2
(45) Date of Patent: May 5, 2026

(54) CARRYING STRAP HANDLE WITH IDENTICAL HALVES

(71) Applicant: Keith Yester, Locust Grove, GA (US)

(72) Inventor: Keith Yester, Locust Grove, GA (US)

( * ) Notice: Subject to any disclaimer, the term of this patent is extended or adjusted under 35 U.S.C. 154(b) by 807 days.

(21) Appl. No.: 18/068,478

(22) Filed: Dec. 19, 2022

(65) Prior Publication Data

US 2024/0197051 A1 Jun. 20, 2024

(51) Int. Cl.
*A45C 13/26* (2006.01)
*A45F 5/10* (2006.01)

(52) U.S. Cl.
CPC ..... *A45C 13/26* (2013.01); *A45F 5/102* (2013.01); *A45F 5/1026* (2013.01)

(58) Field of Classification Search
CPC ..... A45C 13/26; B65D 33/065; B65D 33/08; A45F 5/102; A45F 5/1026; A45F 2005/1013; A45F 2005/1053; A45F 2005/1033
USPC ..... 294/137, 171
See application file for complete search history.

(56) References Cited

U.S. PATENT DOCUMENTS 1,413,690 A * 4/1922 Slocum ..... F16G 11/101 81/487
2,102,839 A * 12/1937 Dohrman ..... A47J 45/10 16/431
2,398,436 A * 4/1946 Mason ..... A47J 45/062 74/543
2,518,006 A * 8/1950 Henriksen ..... A45C 13/26 383/68
3,115,229 A * 12/1963 Erhard ..... A45C 13/26 190/117
3,912,140 A * 10/1975 Franges ..... A45F 5/1046 294/166
4,143,446 A * 3/1979 Down ..... F16G 11/06 403/312
5,088,667 A * 2/1992 Olson ..... B65B 67/1244 248/101
5,616,780 A * 4/1997 Pitteloud ..... C07D 307/00 524/285
5,884,955 A * 3/1999 Pucillo ..... A47J 45/065 294/169
2007/0039151 A1* 2/2007 Crawley ..... A45F 5/102 29/401.1
2021/0292046 A1* 9/2021 Joseph ..... A45F 5/1046

* cited by examiner

*Primary Examiner* — Paul T Chin
(74) *Attorney, Agent, or Firm* — Mark Young, PA; Mark J. Young

(57) ABSTRACT

A handle includes two identical halves, each half including a body, a pair of flanges, a pair of hooks and a pair of slots. The pair of flanges extend towards each other in a common plane. A hook is provided adjacent to one end of each flange. A slot is provided adjacent to the opposite end of each flange. The hook has a head, which defines a wedge-shaped space between the head of the hook and the flange and configured to receive a wedge-shaped overhang of a slot. With two halves positioned on opposite sides of a handle strap, hooks of one half are pressed into slots of the other half, and then the halves are slid until the overhangs fill the wedge-shaped spaces. A set screw may be threaded into a channel that leads to a slot, until the end of the set screw abuts an engaged hook.

20 Claims, 24 Drawing Sheets

CARRYING STRAP HANDLE WITH IDENTICAL HALVES

FIELD OF THE INVENTION

This invention relates generally to handles, and, more particularly, to a supplemental handle comprised of identical halves for assembly on a carrying strap.

BACKGROUND OF THE INVENTION

Many bags for carrying items include one handle strap or a pair of handle straps. A user grabs the handle straps to carry the bag. Often, ends of the handle straps are permanently fastened (e.g., sewn) to the bag. If the contents of the bag are heavy, carrying the bag by grasping the straps can be uncomfortable. Additionally, over time, the unprotected handle straps may wear, especially when the handles straps are repeatedly engaged by a hook from a rolling luggage suitcase.

A nonlimiting example of such a bag is a pilot flight kit bag. Pilots may carry a headset, a tablet computer and charger, a kneeboard, a logbook, aeronautical charts, an E6B flight computer, an aviation airband transceiver with ILS and VOR navigation, flashlights, pens/pencils, and more. Bags designed for containing such equipment typically include one or two strap handles. The handle(s) of a bag containing such equipment may be hooked onto a J-hook of the pilot's suitcase. The weight of the contents may cause discomfort for a user carrying the bag by its strap(s). Over time, the unprotected strap handle(s) will wear due to engagement with the hook of a suitcase.

A supplemental handle for such bags is needed. The supplemental handle should be ergonomic, durable and easy to install on a handle strap without damaging the handle strap. Thus, the supplemental handle should be installable without cutting the handle strap or the stitching that connects the handle strap to the bag. The supplemental handle should be easy to install. When installed, the supplemental handle should remain secure, without appreciable risk of unintended separation from the handle. The supplemental handle should be comprised of identical halves to reduce manufacturing costs.

The invention is directed to overcoming one or more of the problems and solving one or more of the needs as set forth above.

SUMMARY OF THE INVENTION

To solve one or more of the problems set forth above, in an exemplary implementation of the invention, a handle includes two identical halves. Each handle half includes a body, a pair of flanges, a pair of hooks and a pair of slots. The body is generally half of a hollow tube. Each flange extends inwardly from ends of the body. The pair of flanges extend towards each other in a common plane. A hook is provided adjacent to one end of each flange. A slot is provided adjacent to the opposite end of each flange. The hook extends outwardly, away from the body. The hook has a wedge-shaped head, which defines a wedge-shaped space between the head of the hook and the flange. The slot, which is formed on the same side of the flange, is configured (i.e., sized and shaped) to receive, engage and mate with a hook. The slot includes a wedge-shaped undercut configured to fit in the space between the head of the hook and the flange. Two halves are positioned on opposite sides of a handle strap. The two halves are assembled into a handle by pressing the hooks of one half into the slots of the other half, and then sliding one half relative to the other half until the wedge-shaped undercuts fill the wedge-shaped spaces between the heads of the hooks and the flanges. While sliding, the wedge shapes urge one half towards the other half, increasing frictional retention between the halves, and eliminating any space between the contacting surfaces of the halves. The handle strap is disposed between the two assembled halves. To prevent unintended withdrawal of a hook from a slot, a set screw may be threaded into a channel that leads to a slot, until the end of the set screw abuts an engaged hook.

In one exemplary embodiment, each handle half is an integrally formed injection molded plastic structure that includes a body, such as a half section of a tubular structure, including a first edge, a second edge apart from and parallel to the first edge, and a concave base extending from the first edge to the second edge. A first flange having an anterior surface, a first end and a second end, a first side and a second side, extends from the first edge. The anterior surface of the first flange is planar, except for a first hook and a first slot formed on the anterior surface of the first flange. A second flange extends from the second edge towards the first flange. The first flange extends from the first edge of the body towards the second flange. The second side of the first flange is opposite the second side of the second flange. A gap (i.e., space devoid of structure) is between the second side of the first flange and the second side of the second flange. The second flange has an anterior surface, a first end and a second end, a first side and a second side. The anterior surface of the second flange is planar except for a second hook and a second slot formed on the anterior surface of the second flange. The anterior surface of the first flange is aligned with the anterior surface of the second flange. The anterior surface of the first flange and the anterior surface of the second flange is perpendicular to a plane bisecting the body.

Each flange includes a hook and a slot. The hook extends outwardly from the anterior surface of the flange adjacent to the an end of the flange. The slot is a concave compartment through the anterior surface of the flange adjacent to the other end of the flange.

Each hook includes a hook bottom at an angle relative to the anterior surface of the flange. For mating engagement, each slot includes a leading edge, a trailing edge opposite the first leading edge, and an overhang, which is a wedge-shaped structure with an outer surface and an inner surface. The wedge shaped structure extends from the leading edge towards the trailing edge. A wedge angle between the outer surface and the inner surface of the wedge-shaped structure of the overhang is about equal to the first angle. An opening between the trailing edge of each slot and the overhang is sized to receive a hook.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

A handle according to principles of the invention includes two identical halves. Each handle half includes a body, a pair of flanges, a pair of hooks and a pair of slots. The body is generally half of a hollow tube. Each flange extends inwardly from ends of the body. The pair of flanges extend towards each other in a common plane. A hook is provided adjacent to one end of each flange. A slot is provided adjacent to the opposite end of each flange. The hook extends outwardly, away from the body. The hook has a wedge-shaped head, which defines a wedge-shaped space between the head of the hook and the flange. The slot, which is formed on the same side of the flange, is configured (i.e., sized and shaped) to receive, engage and mate with a hook. The slot includes a wedge-shaped undercut configured to fit in the space between the head of the hook and the flange. Two halves are positioned on opposite sides of a handle strap. The two halves are assembled into a handle by pressing the hooks of one half into the slots of the other half, and then sliding one half relative to the other half until the wedge-shaped undercuts fill the wedge-shaped spaces between the heads of the hooks and the flanges. While sliding, the wedge shapes urge one half towards the other half, increasing frictional retention between the halves, and eliminating any space between the contacting surfaces of the halves. The handle strap is disposed between the two assembled halves. To prevent unintended withdrawal of a hook from a slot, a set screw may be threaded into a channel that leads to a slot, until the end of the set screw abuts an engaged hook. As used herein, carrying strap and handle strap are synonymous. Handle straps broadly include nylon webbing straps; such straps comprised of other materials; and flexible cord, rope and string handles comprised of synthetic or natural fibers, filaments, or yarns.

Figure 1:
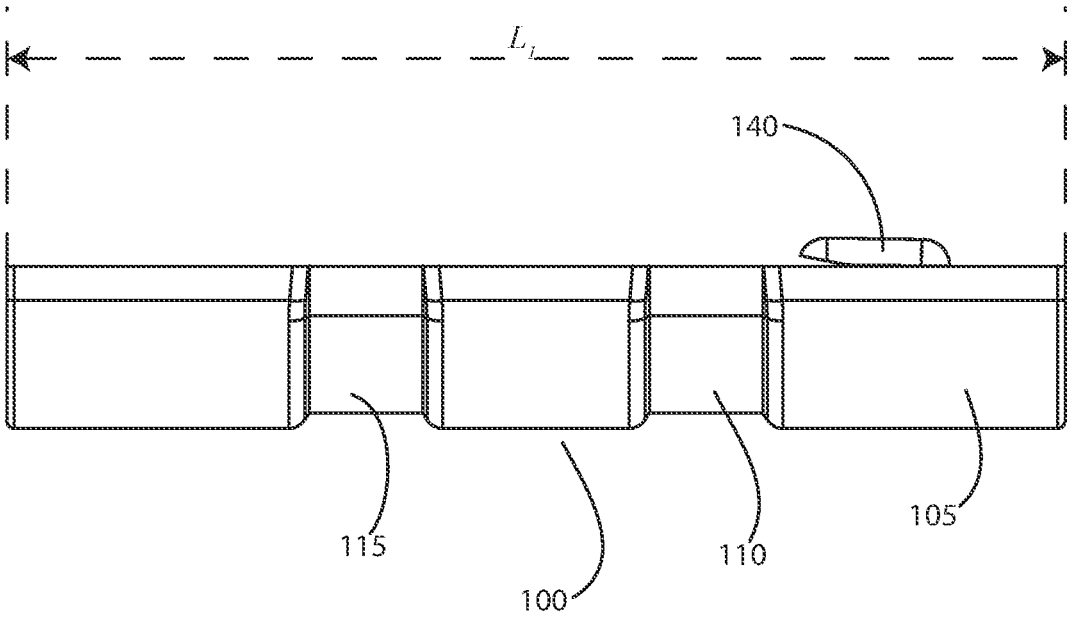
FIG. 1 is a front view of an exemplary handle half according to principles of the invention.
Figure 2:
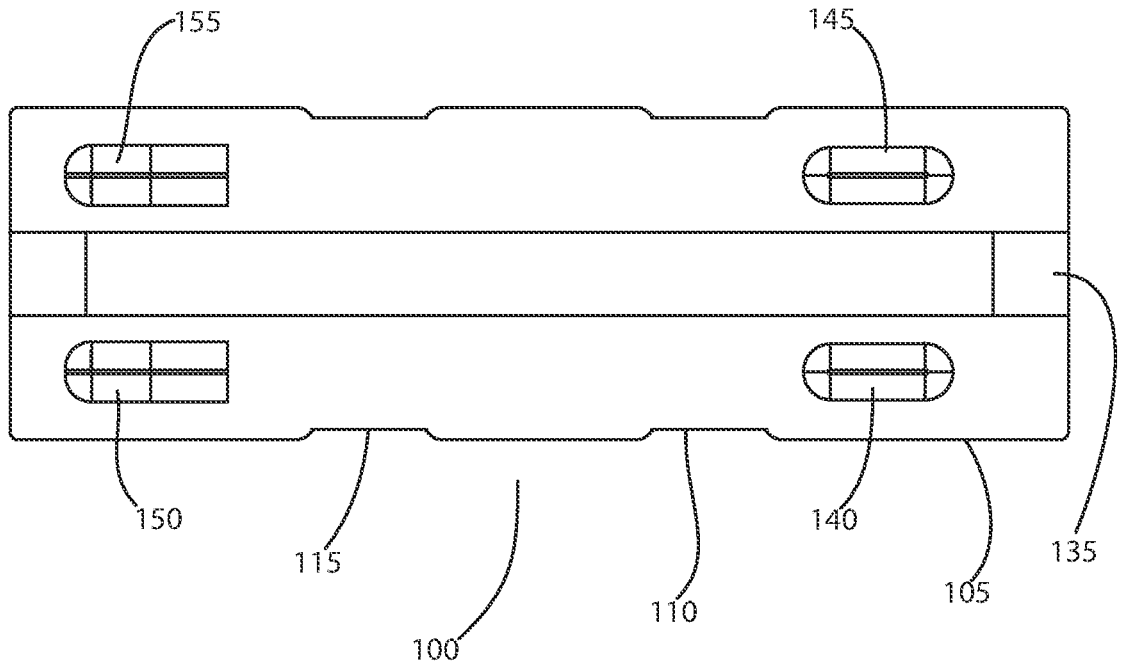
FIG. 2 is a plan view of an exemplary handle half according to principles of the invention.
Figure 3:
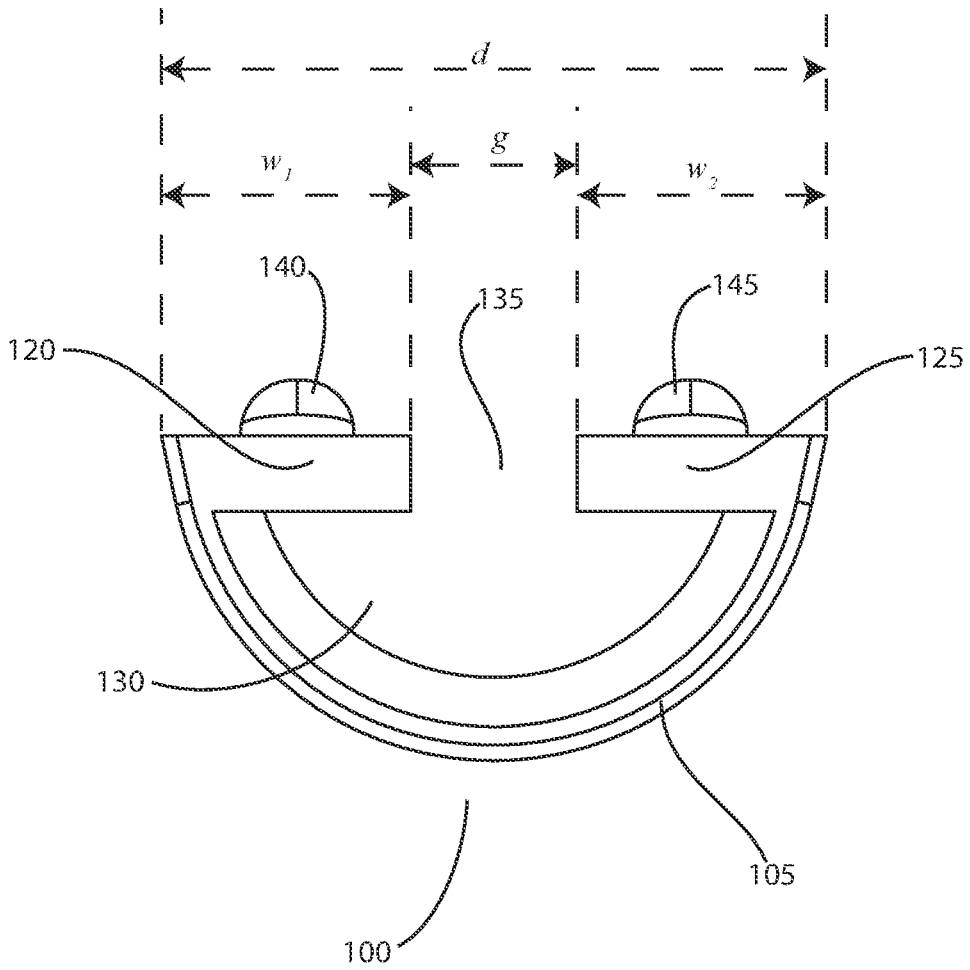
FIG. 3 is a side view of an exemplary handle half according to principles of the invention.

FIGS. 1-5 conceptually illustrate an exemplary handle half 100 according to principles of the invention. The handle half 100 includes a body 105. The body 105 is generally half of a hollow tube. In the exemplary embodiment, the tube is a hollow cylinder, and the handle half is a half of the tube defined along a plane intersecting the longitudinal axis of the tube. In such an embodiment the body 105 has a C-shaped cross-section as shown in FIG. 3.

The body 105 includes interior and exterior surfaces. Exterior surfaces may be gripped by a user's hand, when the handle is in use. Interior surfaces are opposite to the exterior surfaces. Interior surfaces may abut a handle strap, when the handle is in use.

The exterior surface of the exemplary body 105 may include one or more recesses 110, 115 for aesthetics and ergonomics. Other features, such as cushioning may be applied to the exterior surface.

The interior of the body 105 defines a C-shaped compartment in which an engaged portion of a handle strap is received. The interior of the body 105 may be smooth, textured, or marked with recesses and/or protrusions. If the body 105 is molded with a consistent wall thickness, then the interior surface will be the negative of the exterior surface, with exterior recesses providing interior protrusions.

Figure 4:
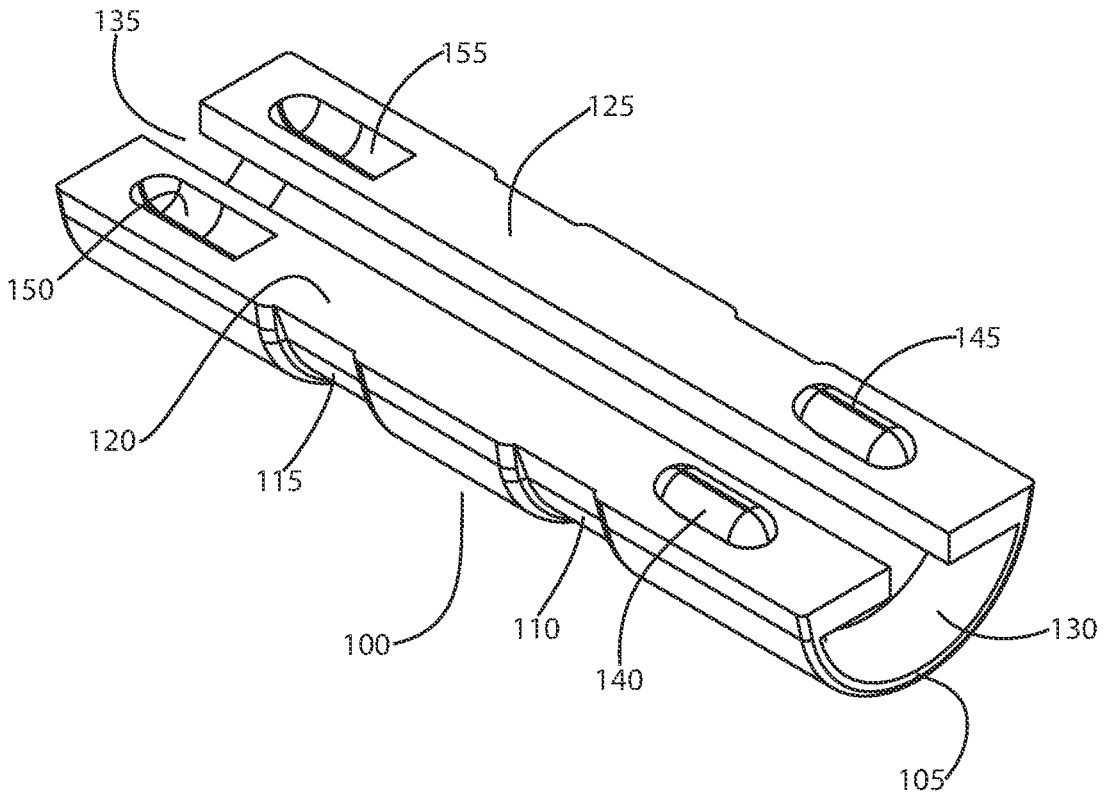
FIG. 4 is a first perspective view of an exemplary handle half according to principles of the invention.
Figure 5:
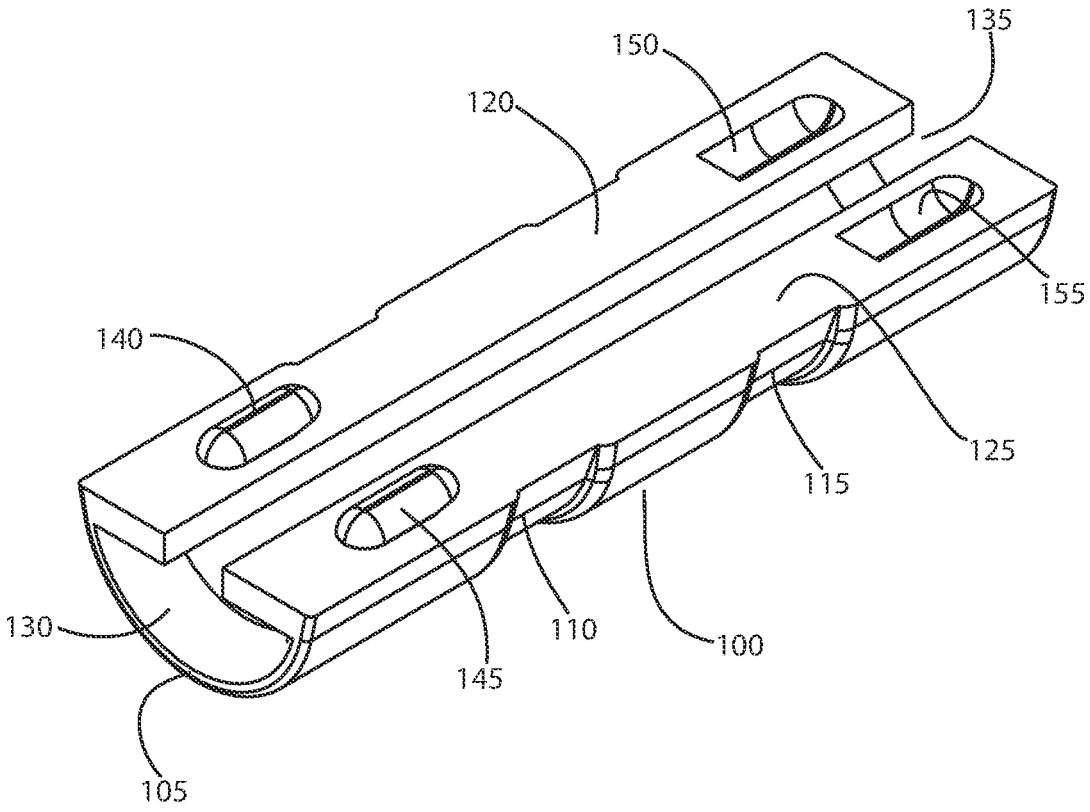
FIG. 5 is a second perspective view of an exemplary handle half according to principles of the invention.

A flange 120, 125 extends inwardly from each side of the body 105, i.e., from each leg of the C. The flanges 120, 125 are opposed. The flanges 120, 125 are aligned. The flanges 120, 125 are spaced apart. A gap 135 (empty space) is disposed between the opposed free ends of the flanges 120, 125. The upper and lower surfaces of the flanges 120, 125 are generally planar, excepting the hooks 140, 145 and slots 150, 155 formed on the upper surfaces of the flanges 120, 125. A plane bisecting one flange will bisect the other flange. The widths, $w_1$ and $w_2$, of the flanges 120, 125 are equal; i.e., $w_1=w_2$. The sum of the widths, $w_1+w_2$, of the flanges 120, 125 is less than the diameter, d, of the cross-section of the handle half 105. The sum of the gap width, g, and the widths, $w_1+w_2$, of the flanges 120, 125 equals the diameter, d; i.e., $g+w_1+w_2=d$. The flanges 120, 125 are coextensive with the body 105, meaning they extend from end to end, as shown in FIGS. 4 and 5.

A C-shaped concave compartment 130 is formed beneath the gap 135 and flanges 120, 125. The compartment 130 is sized to receive an engaged portion of a handle strap. The compartment 130 is coextensive with the body 105, meaning it extends from end to end, as shown in FIGS. 4 and 5.

Figure 6:
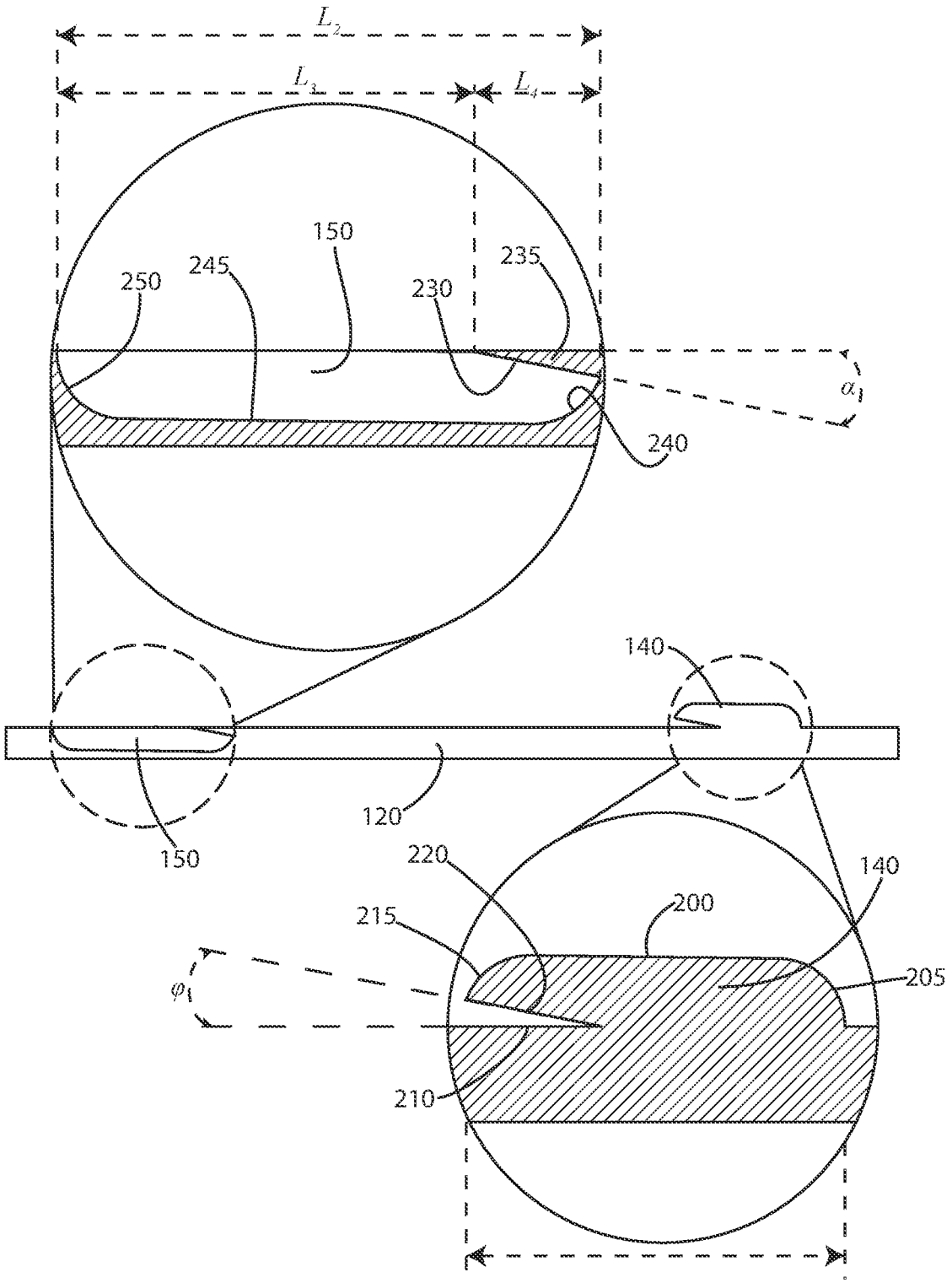
FIG. 6 is a front view of a section of a portion of an exemplary handle half according to principles of the invention.
Figure 7:
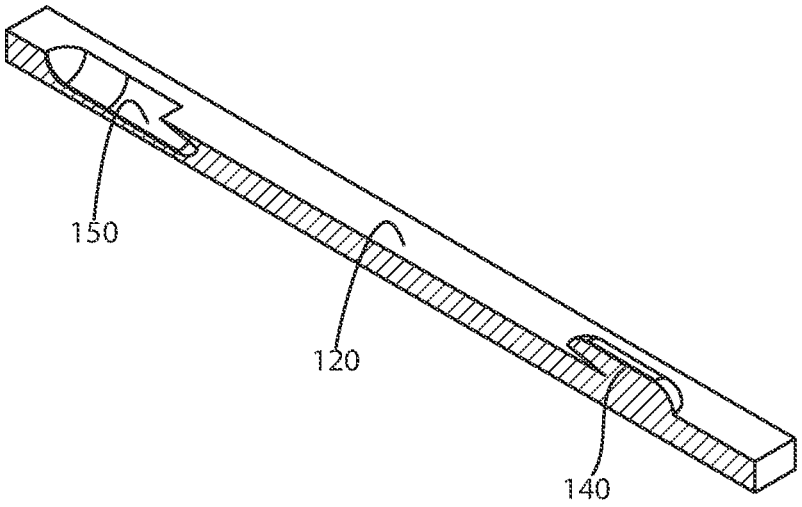
FIG. 7 is a first perspective view of a section of a portion of an exemplary handle half according to principles of the invention.
Figure 8:
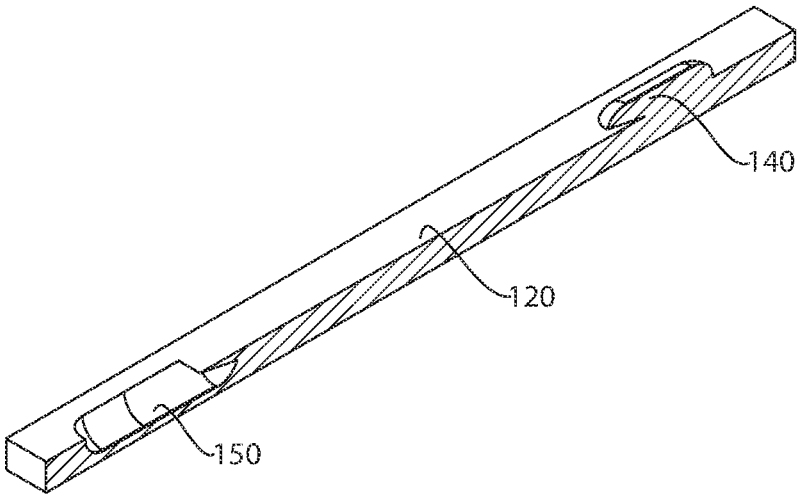
FIG. 8 is a second perspective view of a section of a portion of an exemplary handle half according to principles of the invention.
Figure 9:
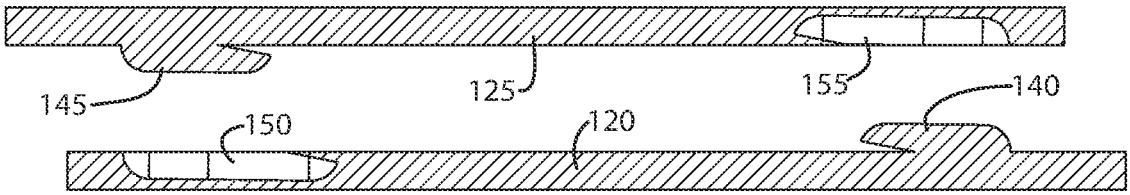
FIG. 9 is a front view of sections of portions of a pair of exemplary handle halves according to principles of the invention.
Figure 10:
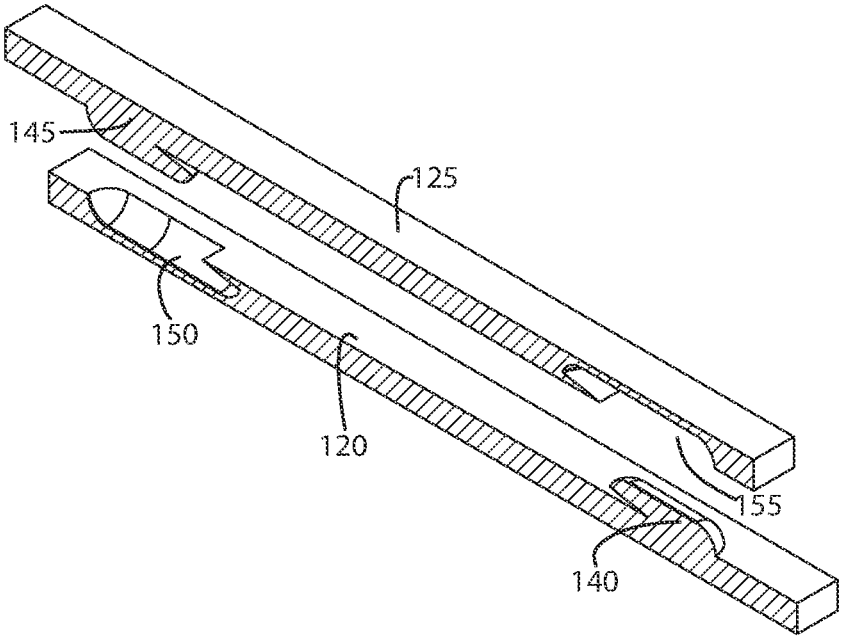
FIG. 10 is a perspective view of sections of portions of a pair of exemplary handle halves according to principles of the invention.
Figure 11:
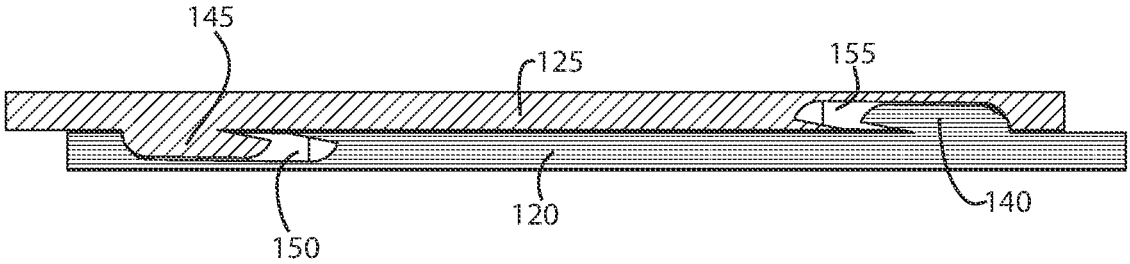
FIG. 11 is a front view of engaged sections of portions of a pair of exemplary handle halves according to principles of the invention.
Figure 12:
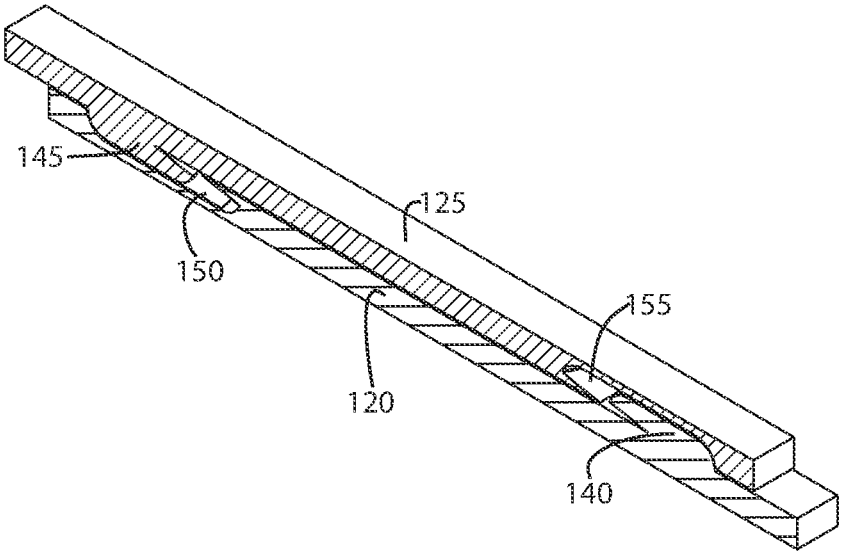
FIG. 12 is a perspective view of engaged sections of portions of a pair of exemplary handle halves according to principles of the invention.
Figure 13:
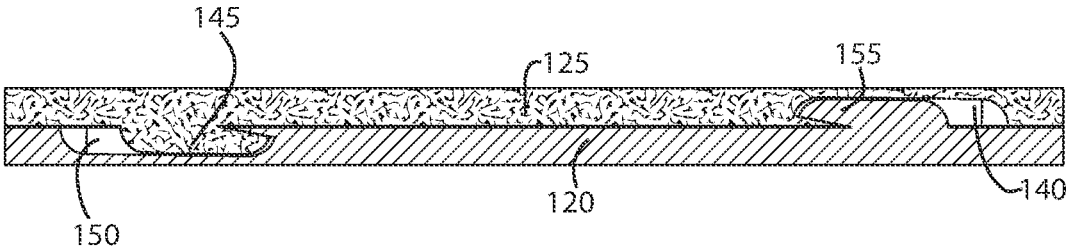
FIG. 13 is a front view of mated sections of portions of a pair of exemplary handle halves according to principles of the invention.
Figure 14:
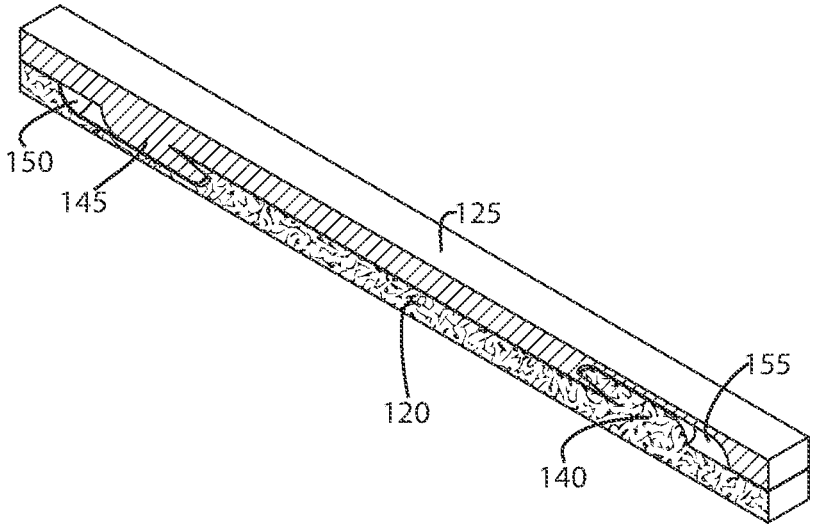
FIG. 14 is a perspective view of mated sections of portions of a pair of exemplary handle halves according to principles of the invention.

Referring now to FIGS. 6-8, the geometry and configuration of a hook and slot are conceptually illustrated. FIG. 6 provides a front view of a section of a flange 120 of an exemplary handle half 100 according to principles of the invention. The section reveals the shape and configuration of the hook 140 and the slot 150. The hook 145 and slot 155 of the other flange 125 are identical to the hook 140 and the slot 150 of the shown flange 120. Focusing on the magnified view of the section of the hook 140, an angled gap (angle q) is defined between the bottom 220 of the leading edge 215 and the outer surface (i.e., anterior surface) 220 of the flange 120. The angle, q, of the gap is about equal to the angle, $\alpha$, of the overhang 235. Angles q and a are acute and about equal. For sufficient structural integrity, $\varphi$ and $\alpha$ are at least 5 degrees. The depth of the gap is defined by the length, $L_2$, of the bottom 220 of the leading edge 215, which about equals the length, $L_5$, of the bottom 230 of the overhang 235. The leading edge 215 of the hook 140 is generally a filleted wedge-shape structure, which is configured to mate with and abut the leading edge 240 of the slot 150. The top of the hook 140 levels off to a generally straight outer surface 200. The height of the hook 140 above the upper surface of the flange 120 is $h_1$, which about equals the depth $h_2$ of the slot 150. The length, $L_1$, of the hook is about equal to the length, $L_4$, of the opening 225 of the slot 150. The outer surface 200 of the hook 140 may slide along the bottom 245 of the slot 150 for engagement and disengagement. The trailing edge 205 of the hook 140 is filleted edge configured to mate with and abut the filleted trailing edge 250 of the slot 150.

The opening 225 of the slot 150 is sized to receive the hook 140. The overhang 235 is a wedge shaped structure with a top surface that is level and co-planar with outer surface 220 of the flange 120. The overhang 235 extends from the leading edge 240 of the slot 150 towards the trailing edge 250 of the slot 150. The total length, $L_3$, of the slot 150 is greater than the length, $L_1$, of the hook 140, by about the length, $L_5$, of the bottom 230 of the overhang 235.

The dimensions discussed above allow each hook of one handle half to releasably engage a slot of another handle half. By way of example, as conceptually illustrated in FIGS. 9-14, a hook 140 of a flange 120 of one handle half may be received through the opening in the slot 155 of a flange 125 of another handle half, and pressed until the trailing edge of the hook 140 mates with and abuts the trailing edge of the slot 155. Concomitantly, a hook 145 of a flange 125 of the other handle half may be received through the opening in the slot 150 of flange 120, and pressed until the trailing edge of the hook 145 mates with and abuts the trailing edge of the slot 150. Then, each hook 140, 145 may be moved, via linear translation (e.g., slid), towards the leading edge of the engaging slot 150, 155, until the overhang is received in the angled gap (angle $\varphi_1$) defined between the bottom of the leading edge and the outer surface of the flange 120, 125. While sliding, the wedge shapes urge one half towards the other half, increasing frictional retention between the halves, and eliminating any space between the contacting surfaces of the halves.

While FIGS. 9-14 show two flanges 120, 125, it is understood that each handle half includes two flanges, and each flange includes a hook and a slot. Therefore, the mating engagement of one handle half with another handle half entails a pair of hooks and slots of one handle half mating with a pair of slots and hooks of the other handle half.

Handle halves 100, 102 may be positioned on opposite sides of one or more handle straps 300, 305, with hooks and slots of one half aligned for engagement with slots and hooks of the other half, as conceptually illustrated in FIGS. 15-20. The straps 300, 305 may be attached to any article to be carried, such as, but not limited to a carrying case, flight kit bag, luggage or other carrier. The handle halves 100, 102 are not limited to engaging two handle straps 300, 305 as shown. Rather, the handle halves 100, 102 may engage one or more handle straps, provided that the one or more handle straps fit within one or both concave compartments 130 of the handle halves 100, 102.

Figure 15:
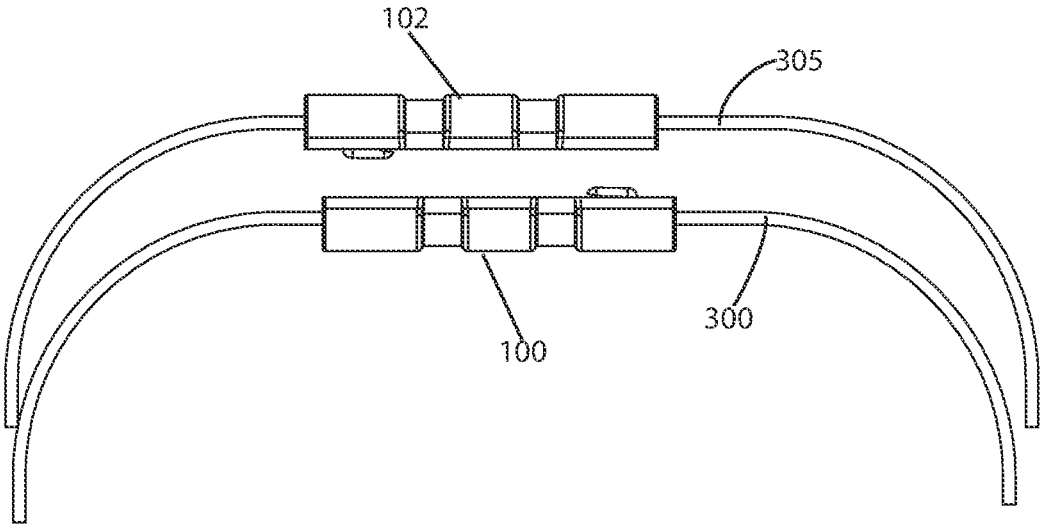
FIG. 15 is a front view of a pair of exemplary handle halves and handle straps according to principles of the invention.
Figure 16:
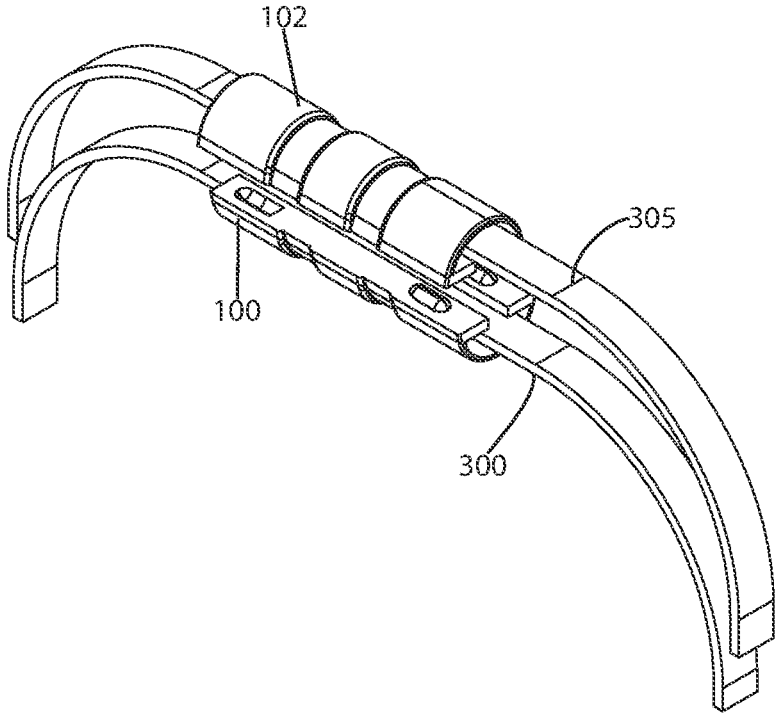
FIG. 16 is a perspective view of a pair of exemplary handle halves and handle straps according to principles of the invention.
Figure 17:
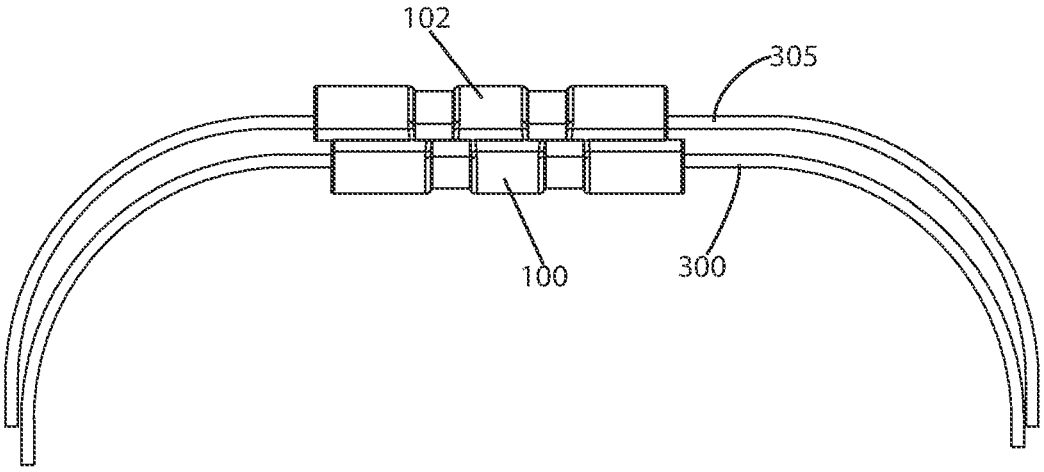
FIG. 17 is a front view of an engaged pair of exemplary handle halves and handle straps according to principles of the invention.
Figure 18:
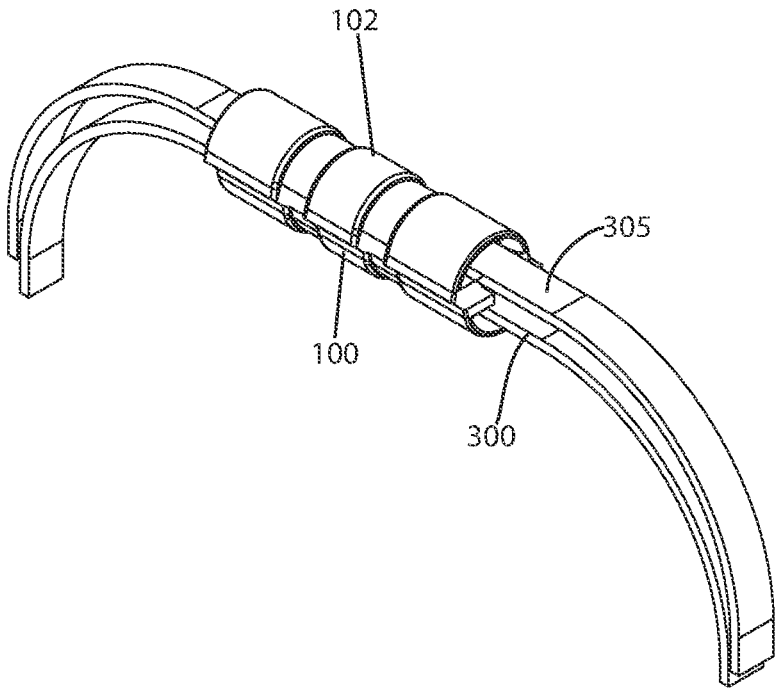
FIG. 18 is a perspective view of an engaged pair of exemplary handle halves and handle straps according to principles of the invention.

In FIGS. 15 and 16 the halves 100, 102 are shown separated and aligned for engagement. In FIGS. 17 and 18 the half 100 abuts (i.e., contacts) half 102, with the hooks of half 100 being within the slots of half 102, and the hooks of half 102 being within the slots of half 100. Thus, a hook of each flange of handle half 100 may be received through the opening in a slot of each flange of handle half 102, and pressed until the trailing edge of each hook mates with and abuts the trailing edge of the slot. Concomitantly, a hook of each flange of handle half 102 may be received through the opening in the slot of each flange of handle half 100, and pressed until the trailing edge of the hook mates with and abuts the trailing edge of the slot. Noticeably, in this configuration, the ends of the handle halves are not aligned.

Figure 19:
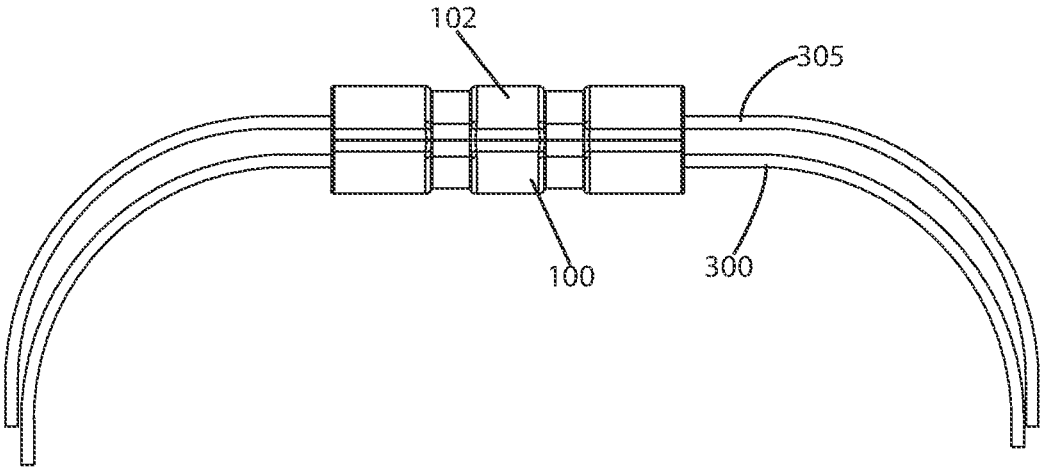
FIG. 19 is a front view of a mated pair of exemplary handle halves and handle straps according to principles of the invention.
Figure 20:
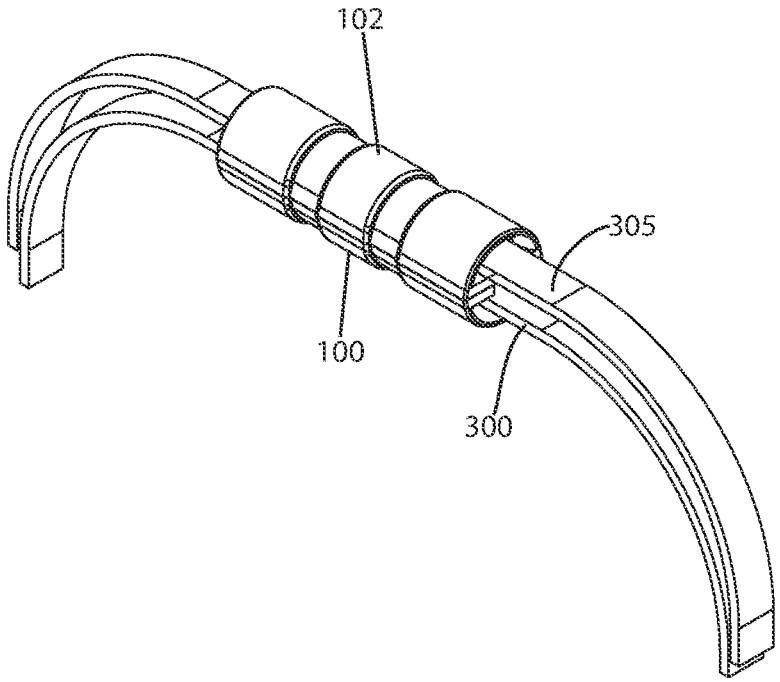
FIG. 20 is a perspective view of a mated pair of exemplary handle halves and handle straps according to principles of the invention.

In FIGS. 19 and 20 the handle halves are slid into alignment. Each hook is moved, relative to the slot in which it is engaged, via linear translation (e.g., slid), towards the leading edge of the engaging slot, until the overhang of the slot is received in the angled gap (angle $\varphi_1$) defined between the bottom of the leading edge of the hook and the outer surface of the flange. Then, the ends of the halves are in alignment. While sliding, the wedge shapes urge one half towards the other half, increasing frictional retention between the halves, and eliminating any space between the contacting surfaces of the halves.

Figure 21:
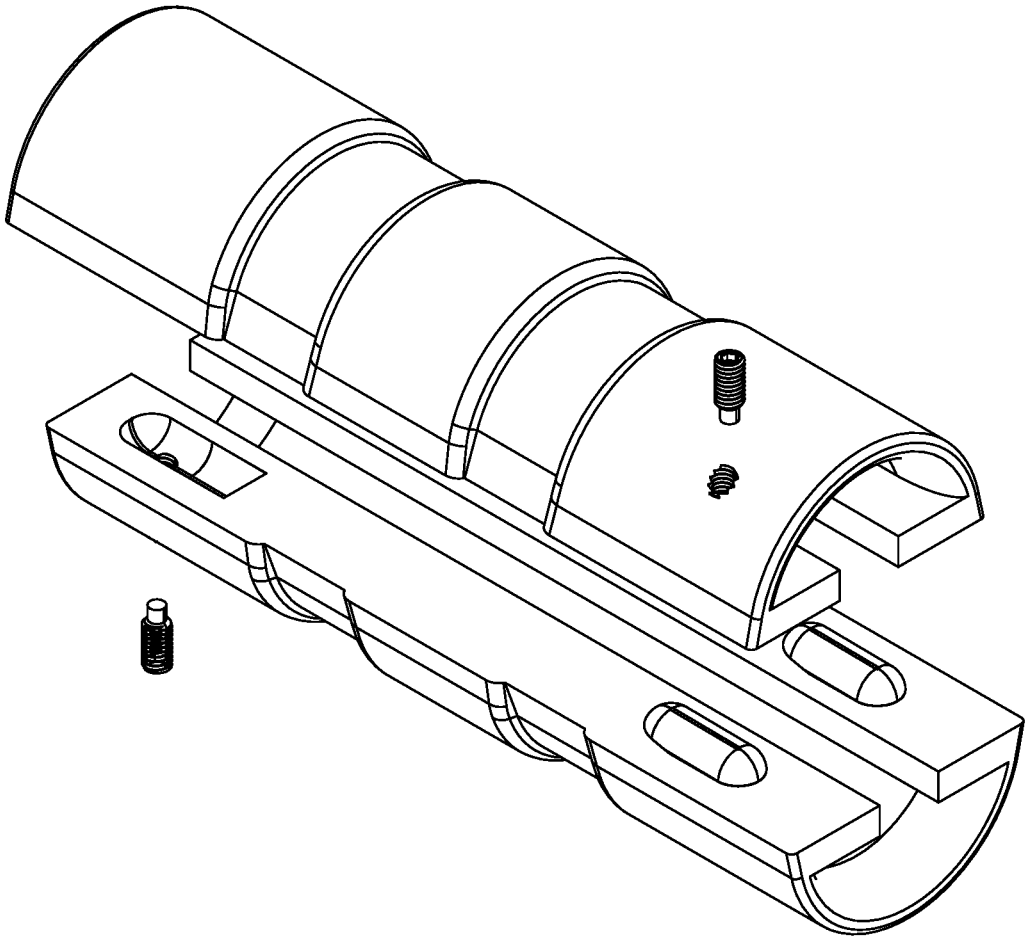
FIG. 21 is a perspective view of a pair of handle halves with set screws and set screw channels configured to retain hooks in slots according to principles of the invention.
Figure 22:
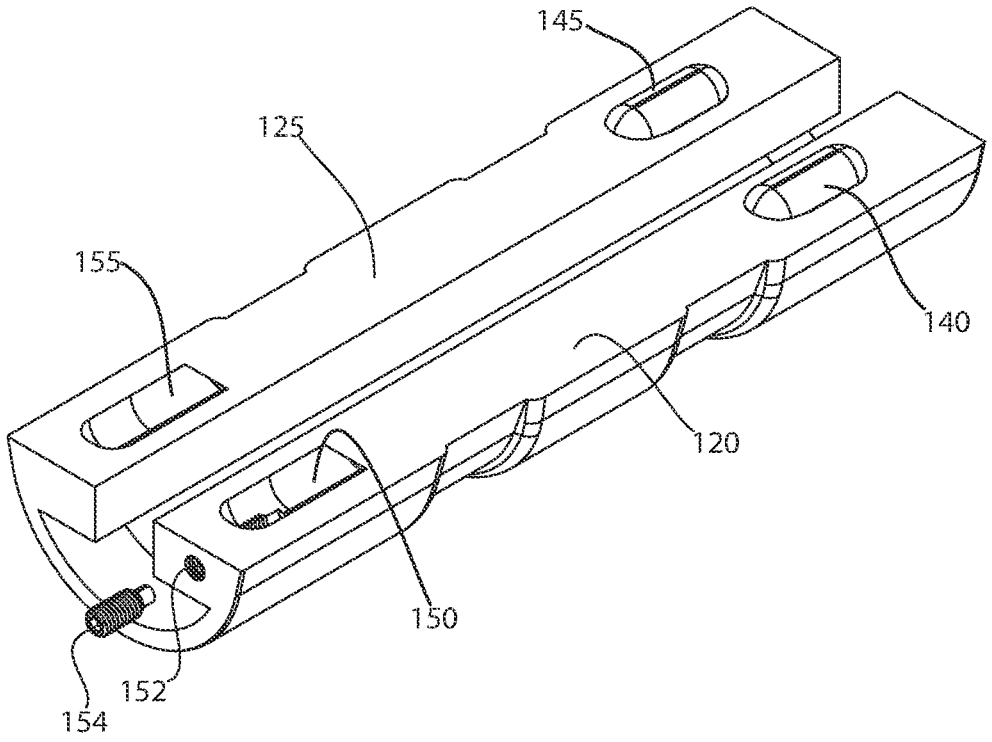
FIG. 22 is another perspective view of a pair of handle halves with set screws and set screw channels configured to retain hooks in slots according to principles of the invention.

The handle halves 100, 102 may be locked together, to avoid unintended separation. Any locking mechanism suitable for use to resist sliding motion may be used. By way of example and not limitation, as shown in FIGS. 21 and 22, a channel 152 may extend from an exterior surface of a handle half into or adjacent to the trailing edge of a slot. The channel 152 may be configured (e.g., threaded) to receive a set screw 154. The set screw 154 may be advanced into the channel 152 until the tip of the set screw 154 extends into the slot. The set screw 154 thus impedes movement of the trailing edge of a hook towards the trailing edge of the slot. Such impediment blocks withdrawal of the hook from the slot. One set screw per half is sufficient to provide locking. However, a half may include a channel and set screw for each slot, without departing from the scope of the invention.

For a more permanent attachment, halves may be bonded together using an adhesive, glue or bonding agent.

Figure 23:
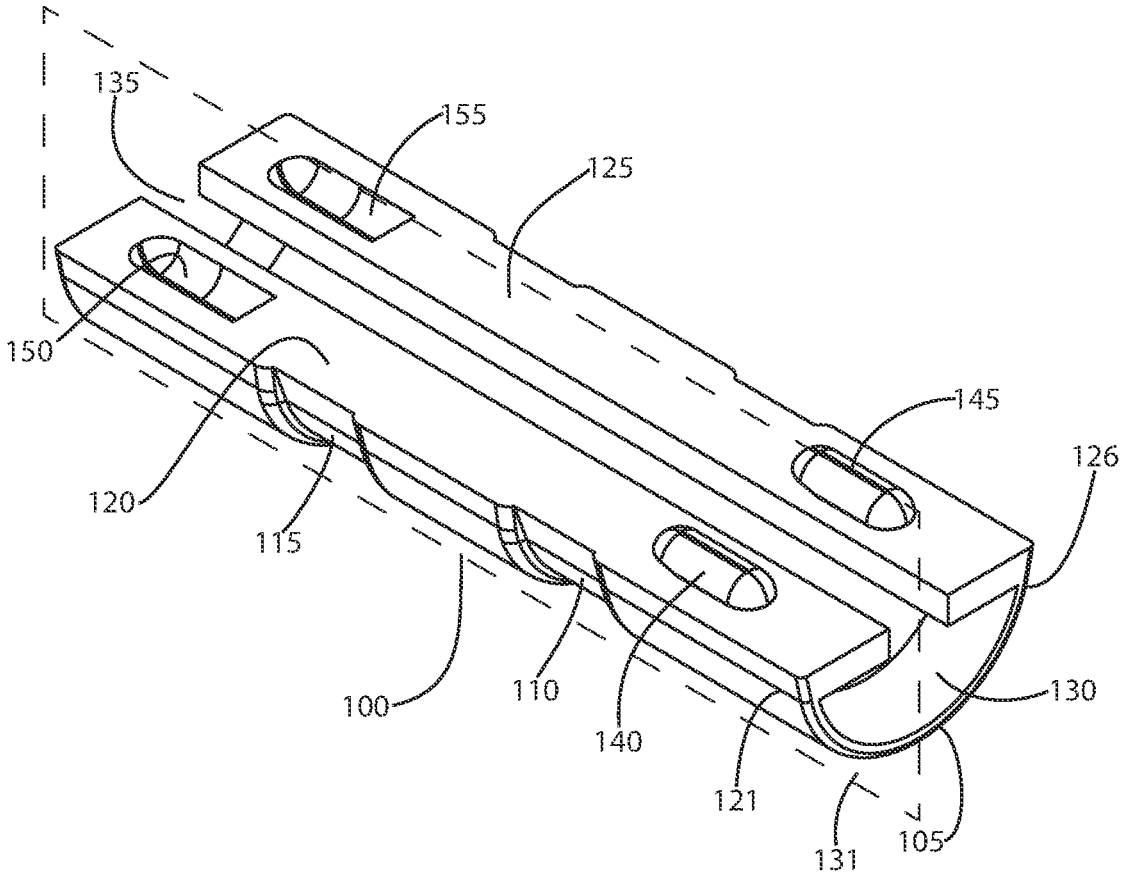
FIG. 23 is a perspective view of a handle half with a bisector plane according to principles of the invention.
Figure 24:
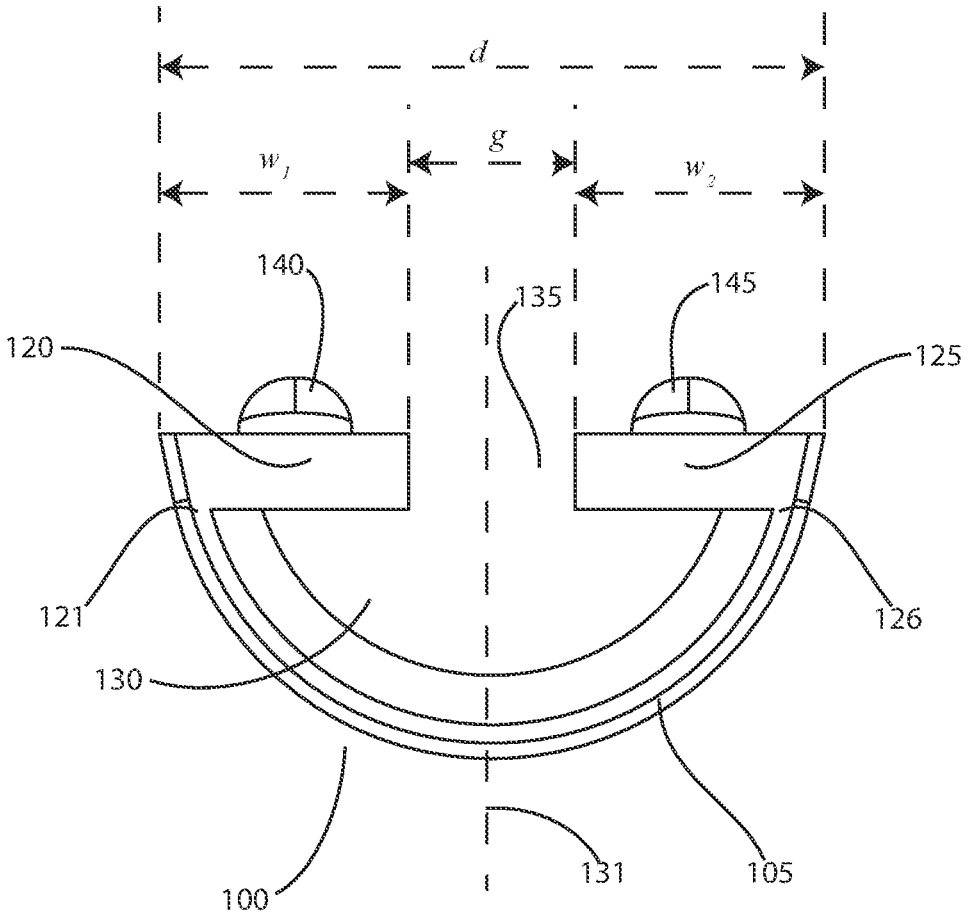
FIG. 24 is a side view of a handle half with a bisector plane according to principles of the invention.

A bisector plane 131 (i.e., an imaginary plane) divides the handle half 100 into two symmetrical parts, as conceptually illustrated in FIGS. 23 and 24. The top (anterior) surface of each flange 120, 125 is perpendicular to the plane 131. Each flange extends from a terminal edge 121, 126 of the body 105.

Handle halves according to principles of the invention may be comprised of metals, alloys, composites and/or any of various plastics. While many other materials may be used alone or in combination with the aforementioned materials and/or other materials, without departing from the scope of the present invention, preferably the material is relatively inexpensive, easy to use in manufacturing operations and results in an aesthetically acceptable, durable, high compression and tensile strength product. By way of example, handle halves according to principles of the invention may be produced using any suitable plastic manufacturing techniques known in the art for the chosen material, such as (for example) injection, compression, structural foam, blow, or transfer molding; polyurethane foam processing techniques; vacuum forming; and casting. The material may further include additives to provide desired properties such as structurally reinforcing additives (e.g., glass or carbon fibers), desired colors, structural characteristics, glow-in-the dark properties and thermal reactivity (e.g., color changes according to heat).

Any dimensions are provided as approximate dimensions for an embodiment. Dimensions may be varied without departing from the scope of the invention. Varied dimensions that do not substantially impair utility of the invention come within the spirit and scope of the invention. Subject to the foregoing, unless otherwise specified herein, dimensions may be varied by ±5% without departing from the scope of the invention.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A handle half comprising:

a body, the body comprising a half section of a tubular structure, including a first edge, a second edge apart from and parallel to the first edge, and a concave base extending from the first edge to the second edge;

a first flange, the first flange having an anterior surface, a first end and a second end, a first side and a second side, the anterior surface of the first flange being planar except for a first hook and a first slot formed on the anterior surface of the first flange, the first hook extending outwardly from the anterior surface of the first flange adjacent to the first end of the first flange, and the first slot comprising a concave compartment through the anterior surface of the first flange adjacent to the second end of the first flange; and a second flange, the second flange having an anterior surface, a first end and a second end, a first side and a second side, the anterior surface of the second flange being planar except for a second hook and a second slot formed on the anterior surface of the second flange, the second hook extending outwardly from the anterior surface of the second flange adjacent to the first end of the second flange, and the second slot comprising a concave compartment through the anterior surface of the second flange adjacent to the second end of the second flange; and the second flange extending from the second edge of the body towards the first flange, and the first flange extending from the first edge of the body towards the second flange, and the second side of the first flange being opposite the second side of the second flange, and a gap being between the second side of the first flange and the second side of the second flange.

2. The handle half of claim 1, wherein the anterior surface of the first flange is aligned with the anterior surface of the second flange.

3. The handle half of claim 2, wherein the anterior surface of the first flange and the anterior surface of the second flange is perpendicular to a plane bisecting the body.

4. The handle half of claim 2, the first hook being identical in shape and size to the second hook and the first slot being identical in shape and size to the second slot.

5. The handle half of claim 4, the first hook being aligned with the second hook and the first slot being aligned with the second slot.

6. The handle half of claim 2 wherein the first hook includes a first hook bottom at a first angle relative to the anterior surface of the first flange, and the second hook includes a second hook bottom at a second angle relative to the anterior surface of the first flange, and the first angle being equal to the second angle.

7. The handle half of claim 6 wherein the first slot includes a first leading edge and a first trailing edge opposite the first leading edge, a first overhang, the first overhang comprising a wedge-shaped structure with a first outer surface and a first inner surface, and the wedge shaped structure extending from the first leading edge towards the first trailing edge, a first wedge angle between the first outer surface and the first inner surface of the wedge-shaped structure of the first overhang being about equal to the first angle.

8. The handle half of claim 7 wherein the second slot includes a second leading edge and a second trailing edge opposite the second leading edge, a second overhang, the second overhang comprising a wedge-shaped structure with a second outer surface and a second inner surface, and the wedge shaped structure extending from the second leading edge towards the second trailing edge, a second wedge angle between the second outer surface and the second inner surface of the wedge-shaped structure of the second overhang being about equal to the second angle.

9. The handle half of claim 8, further comprising a first opening between the first trailing edge of the first slot and the first overhang, and a second opening between the second trailing edge of the second slot and the second overhang, the first opening being about equal in size to the second opening.

10. The handle half of claim 8, the first hook having a first length, and the second hook having a second length, the first length of the first hook being about equal to the second length of the second hook, and the first length not exceeding the first opening between the first trailing edge of the first slot and the first overhang.

11. The handle of claim 10 wherein the handle half is an integrally formed injection molded plastic structure.

12. The handle half of claim 1 wherein the handle half is an integrally formed injection molded plastic structure.

13. A handle comprising two identical handle halves, each handle half comprising:

a body, the body comprising a half section of a tubular structure, including a first edge, a second edge apart from and parallel to the first edge, and a concave base extending from the first edge to the second edge;

a first flange, the first flange having an anterior surface, a first end and a second end, a first side and a second side, the anterior surface of the first flange being planar except for a first hook and a first slot formed on the anterior surface of the first flange, the first hook extending outwardly from the anterior surface of the first flange adjacent to the first end of the first flange, and the first slot comprising a concave compartment through the anterior surface of the first flange adjacent to the second end of the first flange; and a second flange, the second flange having an anterior surface, a first end and a second end, a first side and a second side, the anterior surface of the second flange being planar except for a second hook and a second slot formed on the anterior surface of the second flange, the second hook extending outwardly from the anterior surface of the second flange adjacent to the first end of the second flange, and the second slot comprising a concave compartment through the anterior surface of the second flange adjacent to the second end of the second flange; and the second flange extending from the second edge of the body towards the first flange, and the first flange extending from the first edge of the body towards the second flange, and the second side of the first flange being opposite the second side of the second flange, and a gap being between the second side of the first flange and the second side of the second flange; and the two identical handle halves including a first handle half and a second handle half, the first and second hooks of the first handle half engaging the first and second slots of the second handle half, and the first and second hooks of the second handle half engaging the first and second slots of the first handle half.

14. The handle of claim 13, wherein the anterior surface of the first flange is aligned with the anterior surface of the second flange.

15. The handle of claim 14, wherein the anterior surface of the first flange and the anterior surface of the second flange is perpendicular to a plane bisecting the body.

16. The handle of claim 14, the first hook being identical in shape and size to the second hook and the first slot being identical in shape and size to the second slot.

17. The handle of claim 16, the first hook being aligned with the second hook and the first slot being aligned with the second slot.

18. The handle of claim 13 wherein the first hook includes a first hook bottom at a first angle relative to the anterior surface of the first flange, and the second hook includes a second hook bottom at a second angle relative to the anterior surface of the first flange, and the first angle being equal to the second angle.

19. The handle of claim 18 wherein the first slot includes a first leading edge and a first trailing edge opposite the first leading edge, a first overhang, the first overhang comprising a wedge-shaped structure with a first outer surface and a first inner surface, and the wedge shaped structure extending from the first leading edge towards the first trailing edge, a first wedge angle between the first outer surface and the first inner surface of the wedge-shaped structure of the first overhang being about equal to the first angle.

20. The handle of claim 19 wherein the second slot includes a second leading edge and a second trailing edge opposite the second leading edge, a second overhang, the second overhang comprising a wedge-shaped structure with a second outer surface and a second inner surface, and the wedge shaped structure extending from the second leading edge towards the second trailing edge, a second wedge angle between the second outer surface and the second inner surface of the wedge-shaped structure of the second overhang being about equal to the second angle;

a first opening between the first trailing edge of the first slot and the first overhang, and a second opening between the second trailing edge of the second slot and the second overhang, the first opening being about equal in size to the second opening; and the first hook having a first length, and the second hook having a second length, the first length of the first hook being about equal to the second length of the second hook, and the first length not exceeding the first opening between the first trailing edge of the first slot and the first overhang; and a channel extending into the first trailing edge of the first slot, and a screw threaded into the channel with a portion of the screw extending into the first slot.

* * * * *